US009562718B2

(12) United States Patent
Hodges et al.

(10) Patent No.: US 9,562,718 B2
(45) Date of Patent: Feb. 7, 2017

(54) REBALANCING A MAIN HEAT EXCHANGER IN A PROCESS FOR LIQUEFYING A TUBE SIDE STREAM

(75) Inventors: Derek William Hodges, Dianella (AU); Christiane Kerber, Poecking (DE); Manfred Steinbauer, Raisting (DE); Markus Hammerdinger, Tacherting (DE)

(73) Assignee: LINDE AKTIENGESELLSCHAFT, Munich (DE)

( * ) Notice: Subject to any disclaimer, the term of this patent is extended or adjusted under 35 U.S.C. 154(b) by 1165 days.

(21) Appl. No.: 13/637,992

(22) PCT Filed: Mar. 31, 2011

(86) PCT No.: PCT/AU2011/000374

§ 371 (c)(1),
(2), (4) Date: Jan. 11, 2013

(87) PCT Pub. No.: WO2011/120097

PCT Pub. Date: Oct. 6, 2011

(65) Prior Publication Data

US 2013/0111947 A1 May 9, 2013

(30) Foreign Application Priority Data

Mar. 31, 2010 (AU) ..... 2010901399

(51) Int. Cl.
*F25J 1/00* (2006.01)
*F25J 1/02* (2006.01)
(Continued)

(52) U.S. Cl.
CPC ..... *F25J 1/0022* (2013.01); *F25J 1/0052* (2013.01); *F25J 1/0055* (2013.01); *F25J 1/0244* (2013.01);
(Continued)

(58) Field of Classification Search
CPC ..... F15J 1/0022; F15J 1/0052; F15J 1/0254; F15J 2290/32; F15J 2290/60; F28F 13/06; F28F 27/02; F28D 7/0066; F28D 7/16; F28D 7/0075
(Continued)

(56) References Cited

U.S. PATENT DOCUMENTS 3,450,105 A * 6/1969 Osburn ..... F28F 27/02 122/451 R
3,563,303 A * 2/1971 Gilli ..... F22B 37/38 165/101
(Continued)

FOREIGN PATENT DOCUMENTS

DE 10 2007 036 181 A1 2/2008
JP 56-10692 A 2/1981

OTHER PUBLICATIONS

International Search Report of PCT/AU2011/000374 (Jun. 29, 2011).

*Primary Examiner* — Keith Raymond
(74) *Attorney, Agent, or Firm* — Millen, White, Zelano, Branigan, P.C.

(57) ABSTRACT

A process for liquefying a tube side stream in a main heat exchanger is described. The process comprises the steps of: a) providing a first mass flow to the warm end of a first subset of individual tubes, b) providing a second mass flow to the warm end of a second subset of individual tubes, c) evaporating a refrigerant stream on the shell side; d) measuring an exit temperature of the first mass flow; e) measuring an exit temperature of the second mass flow; and, f) comparing the exit temperature of the first mass flow measured in step d) to the exit temperature of the second mass flow measured in step e), the process characterized in that at least one of the first and second mass flows is adjusted to
(Continued)

equalize the exit temperature of the first mass flow with the exit temperature of the second mass flow.

39 Claims, 2 Drawing Sheets

(51) Int. Cl.

| | |
|---|---|
| ***F28D 7/16*** | (2006.01) |
| ***F28D 7/00*** | (2006.01) |
| ***F28F 13/06*** | (2006.01) |
| ***F28D 7/02*** | (2006.01) |
| ***F28F 13/00*** | (2006.01) |
| ***F28F 13/08*** | (2006.01) |
| ***F28F 27/02*** | (2006.01) |
| ***F28D 1/04*** | (2006.01) |
| ***F25J 5/00*** | (2006.01) |

(52) U.S. Cl.
CPC ..... *F25J 1/0254* (2013.01); *F25J 1/0262* (2013.01); *F25J 1/0267* (2013.01); *F25J 5/002* (2013.01); *F28D 1/0417* (2013.01); *F28D 7/0066* (2013.01); *F28D 7/0075* (2013.01); *F28D 7/024* (2013.01); *F28D 7/16* (2013.01); *F28F 13/00* (2013.01); *F28F 13/06* (2013.01); *F28F 13/08* (2013.01); *F28F 27/02* (2013.01); *F25J 2220/62* (2013.01); *F25J 2290/32* (2013.01); *F25J 2290/60* (2013.01)

(58) Field of Classification Search
USPC ..... 165/294, 295, 296, 300
See application file for complete search history.

(56) References Cited

U.S. PATENT DOCUMENTS 6,272,882 B1 * 8/2001 Hodges ..... F25J 1/0022 62/613
6,370,910 B1 4/2002 Grootjans et al.

* cited by examiner

REBALANCING A MAIN HEAT EXCHANGER IN A PROCESS FOR LIQUEFYING A TUBE SIDE STREAM

FIELD OF THE INVENTION

The present invention relates to a process of liquefying a tube side stream to obtain a liquefied product by rebalancing the heat profile of a main heat exchanger. The present invention relates particularly though not exclusively to a process for liquefying a gaseous, methane-rich feed to obtain a liquefied product known as "liquefied natural gas" or "LNG".

BACKGROUND TO THE INVENTION

A typical liquefaction process is described in U.S. Pat. No. 6,272,882 in which the gaseous, methane-rich feed is supplied at elevated pressure to a first tube side of a main heat exchanger at its warm end. The gaseous, methane-rich feed is cooled, liquefied and sub-cooled against evaporating refrigerant to get a liquefied stream. The liquefied stream is removed from the main heat exchanger at its cold end and passed to storage as liquefied product. Evaporated refrigerant is removed from the shell side of the main heat exchanger at its warm end. The evaporated refrigerant is compressed in at least one refrigerant compressor to get high-pressure refrigerant. The high-pressure refrigerant is partly condensed and the partly condensed refrigerant is separated into a liquid heavy refrigerant fraction and a gaseous light refrigerant fraction. The heavy refrigerant fraction is sub-cooled in a second tube side of the main heat exchanger to get a sub-cooled heavy refrigerant stream. The heavy refrigerant stream is introduced at reduced pressure into the shell side of the main heat exchanger at an intermediate point with the heavy refrigerant stream being allowed to evaporate in the shell side of the main heat exchanger. At least part of the light refrigerant fraction is cooled, liquefied and sub-cooled in a third tube side of the main heat exchanger to get a sub-cooled light refrigerant stream. This light refrigerant stream is introduced at reduced pressure into the shell side of the main heat exchanger at its cold end, and the light refrigerant stream is allowed to evaporate in the shell side.

It is apparent from the description provided above that the tube side of the main heat exchanger is required to handle three streams, namely: i) a gaseous, methane-rich feed which enters the warm end of the first tube side as a gas at elevated pressure, condenses as it travels through the first tube side, and leaves the cold end of the first tube side as a sub-cooled liquefied stream; ii) a heavy refrigerant fraction which enters the warm end of the second tube side as a liquid, is sub-cooled as it travels through the second tube side, and leaves the cold end of the second tube side as a sub-cooled heavy refrigerant stream; and, iii) a least a part of the light refrigerant fraction which enters the warm end of the third tube side as a vapour, is cooled, liquefied and sub-cooled as it travels through the third tube side, and leaves the cold end of the third tube side as a sub-cooled light refrigerant stream.

At the same time, the shell side of the main heat exchanger is required to handle: a) a heavy refrigerant stream which enters the shell side at an intermediate location (at a location referred to in the art as the "top of the warm tube bundle"), and which is evaporated within the shell side before being removed as a gas from the shell side at its warm end; and, b) a light refrigerant stream which enters the shell side at reduced pressure at its cold end (at a location referred to in the art as the "top of the cold tube bundle"), and which is evaporated within the shell side before being removed as a gas from the shell side at its warm end.

Thus, in order to operate in the type of liquefaction process described in U.S. Pat. No. 6,272,882, the main heat exchanger must be capable of handling both single and two phase streams, all of which condense at different temperatures, with multiple tube-side and shell-side streams being accommodated in the one exchanger. The main heat exchanger must also be capable of handling streams having a broad range of temperatures and pressures. For this reason, the main heat exchanger used in liquefaction plants around the world is a "coil-wound" or "spiral-wound" heat exchanger.

In such coil-wound heat exchangers, the tubes for each of the individual streams are distributed evenly in multiple layers which are wound around a central pipe or mandrel to form a "bundle". Each of the plurality of layers of tubes may comprise hundreds of evenly sized tubes with an even distribution of each of the first, second and third tube side fluids in each layer in proportion to their flow ratios. The efficiency of the main heat exchanger relies on heat transfer between the shell side and the tube side in each of these multiple layers being as balanced as possible—both radially across the bundle and axially along the length of the bundle.

As spiral-wound heat exchangers become larger to perform increased duties, it becomes increasingly difficult to distribute the shell side fluids evenly. This is partly due to the fact that on the shell side, the composition of the heavy and light refrigerant streams change continuously along the length of the main heat exchanger as the light components of the refrigerant boil off first. As a consequence, heat transfer between the shell side and each of the first, second and third tube sides may become uneven across the layers within the bundle. This uneven distribution of temperature in the shell side fluids leads to unevenness in the temperature in portions of each of the tube side fluids at the cold ends of the bundle from each layer of tubes in the bundle, and for the shell-side fluid exiting at the warm end.

When the system is in balance, the temperature difference between the tube sides and the shell side remains relatively constant but narrow along the majority of the length of the main heat exchanger. When the system is out of balance, the close temperature differential between the tube sides and the shell side can become "pinched" at locations where a very small or no temperature differential exists at all. Such pinching causes a drop in efficiency of the main heat exchanger. A consequential drop in efficiency is also experienced in the associated mixed refrigerant compression circuit which receives the fluid exiting the warm end of the shell side of the main heat exchanger. If the main heat exchanger is working correctly, the fluid exiting the warm end of the shell side is a gas. When the main heat exchanger is out of balance, the fluid exiting the warm end of the shell side may comprise a two phase mixture of gas and liquid. Any liquid present represents a significant loss of efficiency and must also be removed to avoid potential damage to the downstream refrigerant compression circuit.

The present invention provides a process and apparatus for improving the efficiency of a main heat exchanger by overcoming at least one of the problems identified above.

SUMMARY OF THE INVENTION

According to a first aspect of the present invention there is provided a process for liquefying a tube side stream in a main heat exchanger having a warm end and a cold end, the main heat exchanger comprising a wall defining a shell side within which is arranged a coil-wound tube bundle, the process comprising the steps of:

a) providing a first mass flow of the tube side stream in gaseous form to the warm end of a first subset of individual tubes, said first subset of individual tubes being evenly distributed radially across the tube bundle;

b) providing a second mass flow of the tube side stream in gaseous form to the warm end of a second subset of individual tubes, said second subset of individual tubes being evenly distributed radially across the tube bundle;

c) evaporating a refrigerant stream on the shell side to provide cooling to the first mass flow and the second mass flow whereby the tube side stream becomes a liquid;

d) measuring an exit temperature of the first mass flow removed as a liquid from the cold end of the first subset of individual tubes;

e) measuring an exit temperature of the second mass flow removed as a liquid from the cold end of the second subset of individual tubes; and, f) comparing the exit temperature of the first mass flow measured in step d) to the exit temperature of the second mass flow measured in step e), the process characterized in that at least one of the first and second mass flows is adjusted to equalise the exit temperature of the first mass flow with the exit temperature of the second mass flow.

According to a second aspect of the present invention there is provided a main heat exchanger for liquefying a tube side stream, the main heat exchanger having a warm end and a cold end in use, the main heat exchanger comprising:

a wall defining a shell side within which is arranged a coil-wound tube bundle;

a means for providing a first mass flow of the tube side stream in gaseous form to the warm end of a first subset of individual tubes, said first subset of individual tubes being evenly distributed radially across the tube bundle;

a means for providing a second mass flow of the tube side stream in gaseous form to the warm end of a second subset of individual tubes, said second subset of individual tubes being evenly distributed radially across the tube bundle;

a distributor for providing a refrigerant stream to the shell side to provide cooling to the first mass flow and the second mass flow by evaporation of the refrigerant stream whereby the tube side stream becomes a liquid;

a first temperature sensor for generating a first signal indicative of an exit temperature of the first mass flow removed as a liquid from the cold end of the first subset of individual tubes;

a second temperature sensor for generating a second signal indicative of an exit temperature of the second mass flow removed as a liquid from the cold end of the second subset of individual tubes;

a controller in communication with a mass flow adjustment means for adjusting one or both of the first mass flow and the second mass flow to equalise the exit temperature of the first mass flow with the exit temperature of the second mass flow.

In one form, the exit temperature of the first mass flow measured in step d) is higher than the temperature of the second mass flow measured in step e) and the first mass flow is reduced compared to the second mass flow. Alternatively, the exit temperature of the first mass flow measured in step d) is lower than the temperature of the second mass flow measured in step e) and the second mass flow is reduced relative to the first mass flow.

In one form, the at least one of the first and second mass flows is adjusted to equalise the exit temperature of the first mass flow with the exit temperature of the second mass flow by adjusting at least one of the first or second mass flows at the cold end of the main heat exchanger. Alternatively, the at least one of the first and second mass flows is adjusted to equalise the exit temperature of the first mass flow with the exit temperature of the second mass flow by adjusting at least one of the first or second mass flows at the warm end of the main heat exchanger.

The first mass flow may be adjusted by reducing the number of individual tubes in the first subset of individual tubes, by plugging or removing one or more individual tubes in the first subset of individual tubes, or, by restricting the first mass flow supplied to the first subset of individual tubes. Analogously, the second mass flow may be adjusted by reducing the number of individual tubes in the second subset of individual tubes, by plugging or removing one or more individual tubes in the second subset of individual tubes, or, by restricting the first mass flow supplied to the second subset of individual tubes.

In one form, the tube bundle comprises a warm tube bundle arranged towards the warm end of the tube bundle, and a cold tube bundle arranged towards the cold end of the tube bundle, each of the warm tube bundle and the cold tube bundle having a warm end and a cold end. Throughout this specification, reference to "the tube bundle" where not otherwise specified is used to cover the situation where a main heat exchanger has a single tube bundle as well as the situation where the tube bundle is made up of a separate warm tube bundle and a separate cold tube bundle.

In one form, the tube side stream is a first tube side stream which enters the warm end of the warm tube bundle as a liquid and exits the cold end of the cold tube bundle as a sub-cooled liquid. In one form, the first tube side stream may enter the warm end of the warm tube bundle as a gaseous, methane-rich feed which has been liquefied by the time it passes from the warm end of the warm tube bundle into the warm end of the cold tube bundle. In one form, the first tube side stream enters the warm end of the cold tube bundle as a liquid and exits the cold end of the cold tube bundle as a sub-cooled liquid. The sub-cooled liquid may be removed from the cold end of the cold tube bundle of the main heat exchanger before being directed to storage In one form, the first tube side stream exchanges heat with a predominately liquid light refrigerant stream which is progressively boiled off on the shell side of the cold tube bundle. The evaporated refrigerant removed from the warm end of the shell side of the main heat exchanger may be fed to first and second refrigerant compressors in which the evaporated refrigerant is compressed to form a high pressure refrigerant stream. The high pressure refrigerant stream may be directed to a heat exchanger in which it is cooled so as to produce a partly-condensed refrigerant stream which is then directed in a separator to separate out a heavy refrigerant fraction in liquid form and a light refrigerant fraction in gaseous form. The heavy refrigerant fraction may become a second tube side stream which is supplied at the warm end of the warm tube bundle as a liquid and exits at the cold end of the warm tube bundle as a sub-cooled heavy refrigerant stream in liquid form. The sub-cooled heavy refrigerant stream removed at the cold end of the warm tube bundle may be expanded across a first expansion device to form a reduced pressure heavy refrigerant stream that is then introduced into the shell side of the main heat exchanger at a location intermediate between the cold end of the warm tube bundle and the warm end of the cold tube bundle, and wherein said reduced pressure heavy refrigerant stream is allowed to evaporate in the shell side, thereby cooling the fluids in the first, second and third tube side streams as they pass through the warm tube bundle.

A part of the light refrigerant fraction from the separator may become a third tube side stream which is introduced into the warm end of the warm tube bundle as a gas and exits at the cold end of the cold tube bundle as a sub-cooled liquid. The third tube side stream may be cooled from a gas to a liquid as it passes through the warm tube bundle and is cooled from a liquid to a sub-cooled liquid as it passes through the cool bundle. The sub-cooled light refrigerant stream removed from the cold end of the cold tube bundle may be expanded through a second expansion device to cause a reduction in pressure and produce a reduced pressure light refrigerant stream. The reduced pressure light refrigerant stream is introduced into the shell side of the main heat exchanger at its cold end, and wherein said reduced pressure light refrigerant stream is allowed to evaporate in the shell side, thereby cooling the fluids in the first and third tube side streams as they travel through the cold tube bundle as well as providing cooling to the fluids in the first, second and third tube side streams as they travel through the warm tube bundle.

In one form, the controller of the main heat exchanger of communicates with the mass flow adjustment means to reduce the first mass flow compared to the second mass flow when the first signal is higher than the second signal. In one form, the controller communicates with the mass flow adjustment means to reduce the second mass flow relative to the first mass flow when the first signal is lower than the second signal. In one form, the mass flow adjustment means is configured to adjust one or both of the first mass flow and the second mass flow to equalise the exit temperature of the first mass flow with the exit temperature of the second mass flow at the cold end of the main heat exchanger. In one form, the mass flow adjustment means is configured to adjust one or both of the first mass flow and the second mass flow to equalise the exit temperature of the first mass flow with the exit temperature of the second mass flow at the warm end of the main heat exchanger. In one form, the mass flow adjustment means comprises a first mass flow adjustment means for regulating the first mass flow.

In one form, the first mass flow adjustment means is a plug inserted in one or more individual tubes within the first subset of individual tubes to reduce the rate of the first mass flow relative to the rate of the second mass flow. In one form, the first mass flow adjustment means is a valve that restricts the first mass flow to one or more individual tubes within the first subset of individual tubes.

In one form, the mass flow adjustment means comprises a second mass flow adjustment means for regulating the second mass flow. In one form, the second mass flow adjustment means is a plug inserted in one or more of the individual tubes within the second subset of individual tubes to reduce the rate of the second mass flow relative to the rate of the first mass flow. In one form, the second mass flow adjustment means is a valve that restricts the second mass flow to one or more of the individual tubes within the second subset of individual tubes.

According to a third aspect of the present invention there is provided a process for liquefying a tube side stream in a main heat exchanger substantially as herein described with reference to and as illustrated in the accompanying drawings.

According to a fourth aspect of the present invention there is provided a main heat exchanger process for liquefying a tube side stream substantially as herein described with reference to and as illustrated in the accompanying drawings.

DESCRIPTION OF THE DRAWINGS

In order to facilitate a more detailed understanding of the nature of the invention embodiments of the present invention will now be described in detail, by way of example only, with reference to the accompanying drawings, in which.

DESCRIPTION OF EMBODIMENTS OF THE INVENTION

Figure 1:
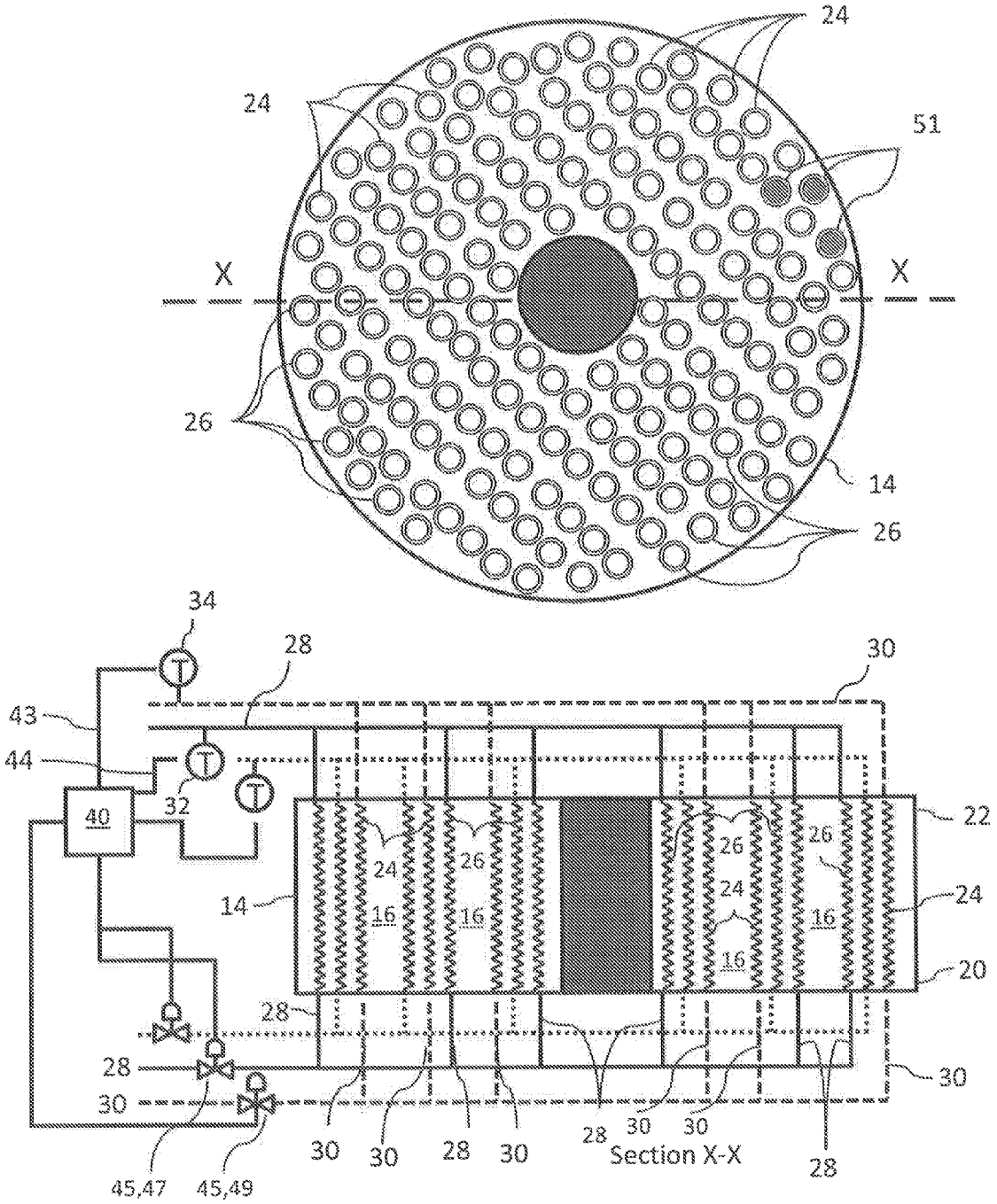
FIG. 1 shows schematically the distribution of flows to subsets of individual tubes of a spiral wound main heat exchanger according to one embodiment of the present invention; and, FIG. 2 shows schematically a flow chart of one embodiment of a plant for liquefying natural gas.

Particular embodiments of the process and apparatus of the present invention are now described, with particular reference to a plant for liquefying a gaseous, methane-rich feed gas in the form of natural gas in a main heat exchanger to produce liquefied natural gas, by way of example only. The present invention is equally applicable to a main heat exchanger used for other applications such as the production of ethylene or other plants for the thermal processing of at least two tube side streams. The terminology used herein is for the purpose of describing particular embodiments only, and is not intended to limit the scope of the present invention. Unless defined otherwise, all technical and scientific terms used herein have the same meanings as commonly understood by one of ordinary skill in the art to which this invention belongs. In the drawings, it should be understood that like reference numbers refer to like parts.

Using a typical prior art spiral wound main heat exchanger, individual tubes carrying different tube side streams are distributed as evenly as possible across multiple layers of the tube bundle with the number of tubes allocated to any given type of tube side stream being allocated in substantially in proportion to their flow ratios. As stated above, the efficiency of the main heat exchanger relies on heat transfer between the shell side and the tube side in each of these multiple layers being as balanced as possible—both radially across the bundle and axially along the length of the bundle. In addition the tube bundle is wound in a plurality of layers whereby each tube side stream is introduced to the tube bundle via one or more nozzles arranged to distribute the mass flow of any given type of tube side stream as evenly as possible into each layer across any given radial cross-section of the tube bundle. In an analogous manner, the mass flow of light refrigerant entering the shell side at the cold end of the cold tube bundle in the main heat exchanger is distributed across the shell side using a first distributor (not shown), and the mass flow of heavy refrigerant entering the shell side at the cold end of the warm tube bundle is distributed across the shell side using a second distributor (not shown). This prior art arrangement is advocated for use in maintaining as even a heat balance across the main heat exchanger as possible at all times.

The present invention is based in part on the realisation that it is difficult to fix any imbalance in the temperature, composition or mass flow rate distribution on the shell side of the main heat exchanger. Whilst any vapour phase fractions present in each of the shell side streams are capable of mixing well, the liquid phase fractions present on the shell side do not mix well. This can result in an imbalance in temperature across the tube bundle which cannot be corrected by making adjustments on the shell side. Instead, the Applicants have realised that an improvement in efficiency can be achieved by adjusting the mass flow of at least one of the tube side streams to given subsets of individual tubes.

Figure 2:
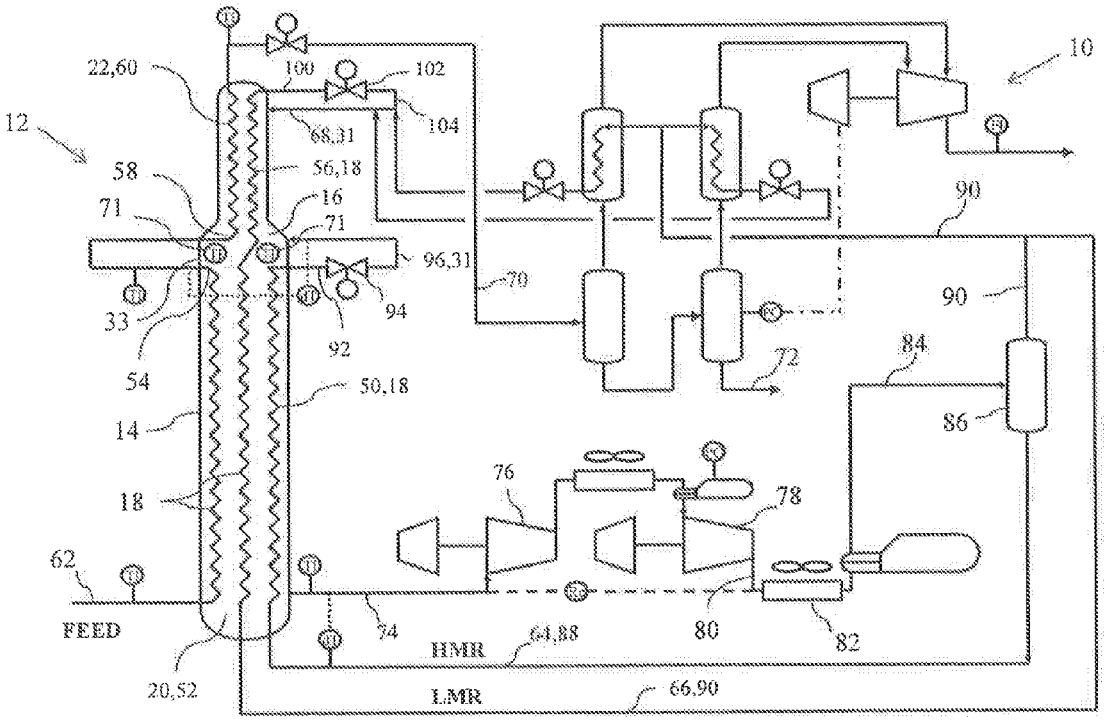

With reference to FIGS. 1 and 2, a process or plant (10) for liquefying a first tube side stream in a main heat exchanger (12) is described, the main heat exchanger (12) having a wall (14) defining a shell side (16) within which is arranged a coil-wound tube bundle (18) having a warm end (20) and a cold end (22), wherein the tube bundle (18) comprises at least a first subset of individual tubes (24) and a second subset of individual tubes (26). Both the first and second subsets of individual tubes are evenly distributed across the radius of the tube bundle. A first mass flow (28) of a tube side stream in gaseous form is supplied to the warm end (20) of the first subset of individual tubes (24) with a second mass flow (30) of the same tube side stream in gaseous form being supplied to the warm end (20) of the second subset of individual tubes (26). A single or mixed refrigerant stream (31) is introduced at the cold end (22) of the main heat exchanger and evaporated on the shell side (16) to provide cooling to the first and second mass flows (28 and 30, respectively) of the tube side stream. The exit temperature of the first mass flow (28) of the tube side stream removed as a liquid from the cold end (22) of the first subset of individual tubes (24) is measured using a first temperature sensor (32) which generates a first signal (41). The exit temperature of the second mass flow (30) of the tube side stream removed as a liquid from the cold end of the second subset of individual tubes (26) is measured using a second temperature sensor (34) which generates a second signal (43). The first signal (41) is compared with the second signal (43) by a controller (40) which communicates with a mass flow adjustment means (45) to adjust one or both of the first mass flow (28) and the second mass flow (30) with a view to equalising the exit temperature of the first mass flow with the exit temperature of the second mass flow. For maximum control, the mass flow adjustment means (45) comprises a first mass flow adjustment means (47) for regulating the first mass flow (28) and a second mass flow adjustment means (49) for regulating the second mass flow (30).

While, ideally, the exit temperature of the first mass flow (28) would ultimately be equal to the exit temperature of the second mass flow (30) for maximum efficiency, the term "equalise" is used throughout this specification and the appended claims to refer to incremental adjustment of at least one of the first and second mass flows to achieve the result that the exit temperature of the first mass flow more closely approaches the exit temperature of the second mass flow.

When the process and apparatus of the present invention is used for liquefaction of a gaseous methane-rich feed to obtain a liquefied natural gas, the mass flow of the tube side stream being adjusted can be one or more of: the first tube side stream (62); the second tube side stream (64); or, the third tube side stream (66). The selection of the at least one tube side stream that is to be subjected to an adjustment of mass flow to effect rebalancing of the thermal profile in the main heat exchanger depends on a number of relevant factors, predominately the size of the temperature differential measured at the cold end for each subset of individual tubes. It is to be appreciated that when the main heat exchanger is being used to thermally process more than one different type of tube side stream (for example a natural gas stream as the first tube side stream and a refrigerant as the second tube side stream), then it is possible that the exit temperature of a first tube side stream may be slightly different from the exit temperature of a second tube side stream. A key feature of the present invention is that the mass flow of each different type of tube side stream is adjusted on a subset of individual tubes by subset of individual tubes basis to ensure that the exit temperature for each different type of tube side stream is the same for each mass flow of said tube side stream through the tube bundle.

Reference is now made to FIG. 2 which illustrates schematically a plant (10) for liquefying a gaseous, methane-rich feed gas in the form of natural gas in a main heat exchanger (12). In this embodiment, the wall (14) of the main heat exchanger (12) defines a shell side (16) within which is arranged two tube bundles, being a warm tube bundle (50) having a warm end (52) and a cold end (54) and a cold tube bundle (56) having a warm end (58) and a cold end (60). The warm tube bundle (50) is arranged towards the warm end (20) of the main heat exchanger (12) and the cold tube bundle (56) is arranged towards the cold end (22) of the main heat exchanger (12). In the embodiment illustrated in FIG. 2, the tube bundle is arranged to received a first tube side stream (62), a second tube side stream (64), and a third tube side stream (66) as described in greater detail below. However, the present invention applies equally to main heat exchanger operating with only one or two tube side streams provided only that a first mass flow of any given tube side stream is directed to flow through a first subset of individual tubes and a second mass flow of said tube side stream is directed to flow through a second subset of individual tubes, with each of the first and second subsets of individual tubes being evenly distributed radially across the coil-wound tube bundle.

In the embodiment illustrated in FIG. 2, the first tube side stream (62) enters the warm tube bundle (50) at elevated pressure as a gaseous, methane-rich feed which has been liquefied and partially sub-cooled by the time it passes from the cold end (54) of the warm tube bundle (50) into the warm end (58) of the cold tube bundle (56). The first tube side stream (62) enters the warm end (58) of the cold tube bundle (56) as a partially sub-cooled liquid and exits the cold end (60) of the cold tube bundle (56) as a further sub-cooled liquid. As it passes through the cold tube bundle (56), the first tube side stream (62) exchanges heat with a predominately liquid light refrigerant stream (68) which is progressively boiled off on the shell side (16) of the cold tube bundle (56). The resulting sub-cooled liquefied first tube side stream (70) is removed from the cold end (22) of the main heat exchanger (12) before being directed to storage (72).

An evaporated mixed refrigerant stream (74) removed from the shell side (16) at the warm end (20) of the main heat exchanger (12) is fed to first and second refrigerant compressors (76 and 78) in which the evaporated refrigerant stream (74) is compressed to form a high pressure refrigerant stream (80). The high pressure refrigerant stream (80) is then directed to one or more heat exchangers (82) in which it is cooled so as to produce a partly-condensed mixed refrigerant stream (84) which is then directed in a separator (86) to separate out a heavy refrigerant fraction in liquid form (88) and a light refrigerant fraction in gaseous form (90). The heavy refrigerant fraction (88) becomes the second tube side stream (64) which enters at the warm end (52) of the warm tube bundle (50) as a liquid and exits at the cold end (54) of the warm tube bundle (56) as a sub-cooled heavy refrigerant stream (92). In this way, the heavy refrigerant second tube side stream remains a liquid at all times as it passes through the warm tube bundle of the main heat exchanger.

The sub-cooled heavy refrigerant stream (92) removed at the cold end (54) of the warm tube bundle (50) is expanded across a first expansion device (94), in the form of a Joule-Thompson valve ("J-T valve"), to form a reduced pressure heavy refrigerant stream (96) that is then introduced into the shell side (16) of the main heat exchanger (12) at a location intermediate between the cold end (54) of the warm tube bundle (50) and the warm end (58) of the cold tube bundle (56). The reduced pressure heavy refrigerant stream (96) is thus one of the refrigerant streams (31) that is allowed to evaporate in the shell side (16), thereby cooling the fluids in the first, second and third tube side streams (62, 64 and 66, respectively) as they pass through the warm tube bundle (50).

Part of the light refrigerant fraction (90) from the separator (86) becomes the third tube side stream (66) which is introduced into the warm end (52) of the warm tube bundle (50) as a gas and exits at the cold end (60) of the cold tube bundle (56) as a sub-cooled liquid light refrigerant stream (100). More specifically, the third tube side stream (66) is cooled from a gas to a liquid and partially sub-cooled as it passes through the warm tube bundle (50) and is further cooled to a sub-cooled liquid as it passes through the cold bundle (56). The sub-cooled light refrigerant stream (100) removed from the cold end (22) of the main heat exchanger (12) is expanded through a second expansion device (102), for example, a hydraulic turbine, to cause a reduction in pressure and produce a reduced pressure light refrigerant stream (104). The reduced pressure light refrigerant stream (104) is thus another of the refrigerant streams (31) introduced into the shell side (16) of the main heat exchanger (12). In this case, the reduced pressure light refrigerant stream (104) starts to evaporate in the shell side (16) to provide cooling to the cold tube bundle (56), thereby cooling the fluids in the first and third tube side streams (62 and 66, respectively) as they travel through the cold tube bundle (56) as well as providing cooling to the fluids in the first, second and third tube side streams (62, 64 and 66, respectively) as they travel through the warm tube bundle (50).

By way of example, the exit temperature of the first mass flow (28) of the first tube side stream (62) is measured for a first subset of individual tubes (24) at the cold end (60) of the cold tube bundle (56) and compared with the exit temperature of the second mass flow (30) of the first tube side stream (62) for a second subset of individual tubes (26) at the cold end (60) of the cold tube bundle (56) using the controller (40). If the exit temperature of the first mass flow (28) is higher than the exit temperature of the second mass flow (30), then the first mass flow (28) is adjusted downwardly relative to the second mass flow (30) to equalise the exit temperature of the first mass flow with the exit temperature of the second mass flow. This downward adjustment is achieved by using the first mass flow adjustment means (45) to reduce or restrict the first mass flow of the first tube side stream to the first subset of individual tubes (24). As a consequence, the second mass flow (30) of the first tube side stream to the second subset of individual tubes (26) effectively increases as the overall mass flow rate of the first tube side stream through the tube bundle does not change (because the total mass flow into the warm end of the main heat exchanger is controlled either upstream or downstream of the main heat exchanger).

Analogously, by way of further example, the exit temperature of a first mass flow (28) of the second tube side stream (64) may be measured for a first subset of individual tubes (24) at the cold end (54) of the warm tube bundle (50) and compared with the exit temperature of a second mass flow (30) of the second tube side stream (64) for a second subset of individual tubes (26) at the cold end (54) of the warm tube bundle (50). If the exit temperature of the first mass flow (28) is lower than the exit temperature of the second mass flow (30), then the first mass flow (28) is adjusted upwardly relative to the second mass flow (30) to equalise the exit temperature of the first mass flow with the exit temperature of the second mass flow. In this way, the mass flow of the second tube side stream through the warm tube bundle is rebalanced until the exit temperature of the first mass flow (28) more closely approaches the exit temperature of the second mass flow (30). The first mass flow (28) is adjusted upwardly by using the second mass flow regulating means (47) to reduce or restrict the second mass flow (30) as the overall mass flow rate of the second tube side stream through the warm tube bundle (56) does not change.

The present invention can be applied to rebalancing one, two or all three of the first, second and third tube side streams in the main heat exchanger of a liquefaction process. The adjustment of the mass flows to a subset of individual tubes using one or both of the first and second mass flow adjustment means (45 and 47, respectively) can take place at either the warm end or the cold end of a tube bundle. The first and second adjustment means can take the form of a valve.

In one embodiment of the present invention, restriction of the mass flow of a tube side stream to a given subset of individual tubes is achieved by effectively reducing the number of individual tubes in said subset by plugging one or more individual tubes in said subset. By way of example, the first mass flow adjustment means (45) may take the form of a flow restriction means in the form of a plug (51) inserted in one or more individual tubes within the first subset of individual tubes (24) to reduce the rate of the first mass flow (28) relative to the rate of the second mass flow (30). In an analogous manner, the second mass flow adjustment means (47) may take the form of a plug inserted in one or more of the individual tubes within the second subset of individual tubes (26) to reduce the rate of the second mass flow (30) relative to the rate of the first mass flow (28). The act of plugging individual tubes is analogous to removing them from the bundle.

Restriction of the mass flow of a tube side stream to a given subset of individual tubes may be achieved by reducing the number of individual tubes in said subset by physically removing one or more individual tubes in said subset.

In another embodiment, one or both of the first and second mass flow adjustment means (45 and 47, respectively) is used to partially restrict the mass flow of a tube side stream through a subset of individual tubes on a tube-by-tube basis. By way of example, the first mass flow adjustment means (45) may take the form of a valve that restricts the first mass flow (28) to one or more individual tubes within the first subset of individual tubes (24). In an analogous manner, the second mass flow adjustment means (47) may take the form of a valve that restricts the second mass flow (30) to one or more of the individual tubes within the second subset of individual tubes (26). Restriction of the mass flow of a tube side stream to a given subset of individual tubes may be achieved by effectively reducing the number of individual tubes in said subset by removing one or more individual tubes in said subset.

It is considered a matter of routine for a person skilled in the art to determine the number of individual tubes within any given subset that should be subjected to restricted or plugged flow to compensate for the difference in the exit temperatures measured for different subsets of individual tubes. The selection process can be assisted using modelling techniques well known in the art.

Each of the patents cited in this specification, are herein incorporated by reference. It will be clearly understood that, although a number of prior art publications are referred to herein, this reference does not constitute an admission that any of these documents forms part of the common general knowledge in the art, in Australia or in any other country. In the summary of the invention, the description and claims which follow, except where the context requires otherwise due to express language or necessary implication, the word "comprise" or variations such as "comprises" or "comprising" is used in an inclusive sense, i.e. to specify the presence of the stated features but not to preclude the presence or addition of further features in various embodiments of the invention.

Now that embodiments of the invention have been described in detail, it will be apparent to persons skilled in the relevant art that numerous variations and modifications can be made without departing from the basic inventive concepts. All such modifications and variations are considered to be within the scope of the present invention, the nature of which is to be determined from the foregoing description and the appended claims.

What is claimed is:

1. A process for liquefying a first tube side stream in a main heat exchanger having a warm end and a cold end, the main heat exchanger comprising a wall defining a shell side within which is arranged a coil-wound tube bundle, the process comprising:

a) introducing a first mass flow of said first tube side stream in gaseous form to a warm end of a first subset of individual tubes of said tube bundle, said first subset of individual tubes being evenly distributed radially across said tube bundle;

b) separate from said first mass flow, introducing a second mass flow of said first tube side stream in gaseous form to a warm end of a second subset of individual tubes of said tube bundle, said second subset of individual tubes being evenly distributed radially across said tube bundle;

c) evaporating a refrigerant stream on the shell side to provide cooling to said first mass flow and said second mass flow whereby said first tube side stream becomes a liquid;

d) measuring an exit temperature of said first mass flow removed as a liquid from a cold end of said first subset of individual tubes;

e) measuring an exit temperature of said second mass flow removed as a liquid from a cold end of said second subset of individual tubes; and f) comparing the exit temperature of said first mass flow measured in step d) to the exit temperature of said second mass flow measured in step e), and adjusting at least one of the first and second mass flows to equalize the exit temperature of said first mass flow with the exit temperature of said second mass flow.

2. The process of claim 1, wherein when the exit temperature of said first mass flow measured in d) is higher than the temperature of said second mass flow measured in e), said first mass flow is reduced compared to said second mass flow.

3. The process of claim 1, wherein when the exit temperature of said first mass flow measured in d) is lower than the temperature of said second mass flow measured in e), said second mass flow is reduced relative to said first mass flow.

4. The process of claim 1, wherein at least one of the first and second mass flows is adjusted to equalize the exit temperature of said first mass flow with the exit temperature of said second mass flow by adjusting at least one of the first or second mass flows at the cold end of the main heat exchanger.

5. The process of claim 1, wherein at least one of the first and second mass flows is adjusted to equalize the exit temperature of said first mass flow with the exit temperature of said second mass flow by adjusting at least one of the first or second mass flows at the warm end of the main heat exchanger.

6. The process of claim 1, wherein said first mass flow is adjusted by reducing the number of individual tubes in said first subset of individual tubes.

7. The process of claim 1, wherein said first mass flow is adjusted by plugging or removing one or more individual tubes in said first subset of individual tubes.

8. The process of claim 1, wherein said first mass flow is adjusted by restricting the first mass flow supplied to said first subset of individual tubes.

9. The process of claim 1, wherein said second mass flow is adjusted by reducing the number of individual tubes in said second subset of individual tubes.

10. The process of claim 1, wherein said second mass flow is adjusted by plugging or removing one or more individual tubes in said second subset of individual tubes.

11. The process of claim 1, wherein said second mass flow is adjusted by restricting the second mass flow supplied to said second subset of individual tubes.

12. The process of claim 1, wherein said tube bundle comprises a warm tube bundle arranged towards a warm end of said tube bundle, and a cold tube bundle arranged towards a cold end of said tube bundle, each of said warm tube bundle and said cold tube bundle having a warm end and a cold end.

13. The process of claim 12, wherein said first tube side stream enters the warm end of said warm tube bundle as a liquid and exits the cold end of said cold tube bundle as a sub-cooled liquid.

14. The process of claim 12, wherein said first tube side stream enters the warm end of said warm tube bundle as a gaseous, methane-rich feed which has been at least partially liquefied by the time said first tube side stream passes from the warm end of said warm tube bundle into the warm end of said cold tube bundle.

15. The process of claim 12, wherein said first tube side stream enters the warm end of said cold tube bundle as a liquid and exits the cold end of said cold tube bundle as a sub-cooled liquid.

16. The process of claim 15, wherein the sub-cooled liquid is removed from the cold end of said cold tube bundle of said main heat exchanger before being directed to storage.

17. The process of claim 12, wherein said first tube side stream exchanges heat with a predominately liquid light refrigerant stream which is progressively boiled off on the shell side of said cold tube bundle.

18. The process of claim 17, wherein evaporated refrigerant removed from a warm end of the shell side of said main heat exchanger is fed to first and second refrigerant compressors in which the evaporated refrigerant is compressed to form a high pressure refrigerant stream.

19. The process of claim 18, wherein the high pressure refrigerant stream is directed to a heat exchanger wherein the high pressure refrigerant stream is cooled to produce a partly-condensed refrigerant stream which is then introduced into a separator to separate out a heavy refrigerant fraction in liquid form and a light refrigerant fraction in gaseous form.

20. The process of claim 19, wherein said heavy refrigerant fraction becomes a second tube side stream which is supplied at the warm end of said warm tube bundle as a liquid and exits at the cold end of said warm tube bundle as a sub-cooled heavy refrigerant stream in liquid form.

21. The process of claim 20, wherein the sub-cooled heavy refrigerant stream removed at the cold end of said warm tube bundle is expanded across a first expansion device to form a reduced pressure heavy refrigerant stream that is then introduced into the shell side of said main heat exchanger at a location intermediate between the cold end of said warm tube bundle and the warm end of said cold tube bundle, and wherein said reduced pressure heavy refrigerant stream is allowed to evaporate in the shell side, thereby cooling the fluids in the first and second tube side streams as they pass through said warm tube bundle.

22. The process of claim 21, wherein part of said light refrigerant fraction from said separator becomes a third tube side stream which is introduced into the warm end of said warm tube bundle as a gas and exits at the cold end of said cold tube bundle as a sub-cooled liquid.

23. The process of claim 22, wherein said third tube side stream is cooled from a gas to a liquid as said third tube side stream passes through said warm tube bundle and is cooled from a liquid to a sub-cooled liquid light refrigerant stream as said third tube side stream passes through said cold bundle.

24. The process of claim 23, wherein said sub-cooled liquid light refrigerant stream removed from the cold end of said cold tube bundle is expanded through a second expansion device to cause a reduction in pressure and produce a reduced pressure light refrigerant stream.

25. The process of claim 24, wherein the reduced pressure light refrigerant stream is introduced into the shell side of said main heat exchanger at the cold end of said main heat exchanger, and wherein said reduced pressure light refrigerant stream is allowed to evaporate in the shell side, thereby cooling the fluids in the first and third tube side streams as they travel through said cold tube bundle as well as providing cooling to the fluids in the first, second and third tube side streams as they travel through said warm tube bundle.

26. A main heat exchanger for liquefying a tube side stream, the main heat exchanger having a warm end and a cold end in use, the main heat exchanger comprising:

a wall defining a shell side within which is arranged a coil-wound tube bundle;

a means for providing a first mass flow of a first tube side stream in gaseous form to a warm end of a first subset of individual tubes of said tube bundle, said first subset of individual tubes being evenly distributed radially across said tube bundle;

a means for providing a second mass flow of the first tube side stream in gaseous form, separate from the first mass flow of the first tube side stream, to a warm end of a second subset of individual tubes of said tube bundle, said second subset of individual tubes being evenly distributed radially across said tube bundle;

a distributor for providing a refrigerant stream to the shell side to provide cooling to the first mass flow and the second mass flow by evaporation of the refrigerant stream whereby the first tube side stream becomes a liquid;

a first temperature sensor for generating a first signal indicative of an exit temperature of the first mass flow removed as a liquid from a cold end of said first subset of individual tubes;

a second temperature sensor for generating a second signal indicative of an exit temperature of the second mass flow removed as a liquid from a cold end of said second subset of individual tubes; and a controller in communication with a mass flow adjustment means for adjusting one or both of the first mass flow and the second mass flow to equalize the exit temperature of the first mass flow with the exit temperature of the second mass flow.

27. The main heat exchanger of claim 26, wherein said controller communicates said mass flow adjustment means to reduce the first mass flow compared to the second mass flow when said first signal is higher than said second signal.

28. The main heat exchanger of claim 26, wherein said controller communicates with said mass flow adjustment means to reduce the second mass flow relative to the first mass flow when said first signal is lower than said second signal.

29. The main heat exchanger of claim 26, wherein said mass flow adjustment means is configured to adjust one or both of the first mass flow and the second mass flow to equalize the exit temperature of the first mass flow with the exit temperature of the second mass flow at the cold end of said main heat exchanger.

30. The main heat exchanger of claim 26, wherein said mass flow adjustment means is configured to adjust one or both of the first mass flow and the second mass flow to equalize the exit temperature of the first mass flow with the exit temperature of the second mass flow at the warm end of said main heat exchanger.

31. The main heat exchanger of claim 26, wherein said mass flow adjustment means comprises a first mass flow adjustment means for regulating the first mass flow.

32. The main heat exchanger of claim 31, wherein said first mass flow adjustment means is a plug inserted in one or more individual tubes within said first subset of individual tubes to reduce the rate of the first mass flow relative to the rate of the second mass flow.

33. The main heat exchanger of claim 31, wherein said first mass flow adjustment means is a valve that restricts the first mass flow to one or more individual tubes within said first subset of individual tubes.

34. The main heat exchanger of claim 26, wherein said mass flow adjustment means comprises a second mass flow adjustment means for regulating the second mass flow.

35. The main heat exchanger of claim 34, wherein said second mass flow adjustment means is a plug inserted in one or more of the individual tubes within said second subset of individual tubes to reduce the rate of the second mass flow relative to the rate of the first mass flow.

36. The main heat exchanger of claim 34, wherein said second mass flow adjustment means is a valve that restricts the second mass flow to one or more of the individual tubes within said second subset of individual tubes.

37. A main heat exchanger for liquefying a tube side stream, the main heat exchanger having a warm end and a cold end in use, the main heat exchanger comprising:

a wall defining a shell side within which is arranged a coil-wound tube bundle;

piping for providing a first mass flow of the tube side stream in gaseous form to a warm end of a first subset of individual tubes, said first subset of individual tubes being evenly distributed radially across the tube bundle;

piping for providing a second mass flow of the tube side stream in gaseous form to a warm end of a second subset of individual tubes, said second subset of individual tubes being evenly distributed radially across the tube bundle;

a distributor for providing a refrigerant stream to the shell side to provide cooling to the first mass flow and the second mass flow by evaporation of the refrigerant stream whereby the tube side stream becomes a liquid;

a first temperature sensor for generating a first signal indicative of an exit temperature of the first mass flow removed as a liquid from a cold end of the first subset of individual tubes;

a second temperature sensor for generating a second signal indicative of an exit temperature of the second mass flow removed as a liquid from a cold end of the second subset of individual tubes; and a controller in communication with a mass flow adjustment means for adjusting one or both of the first mass flow and the second mass flow to equalize the exit temperature of the first mass flow with the exit temperature of the second mass flow, wherein said mass flow adjustment means comprises a first mass flow adjustment means for regulating the first mass flow and/or a second mass flow adjustment means for regulating the second mass flow, wherein said first mass flow adjustment means is a plug inserted in one or more individual tubes within the first subset of individual tubes to reduce the rate of the first mass flow relative to the rate of the second mass flow or a valve that restricts the first mass flow to one or more individual tubes within the first subset of individual tubes, and/or said second mass flow adjustment means is a plug inserted in one or more of the individual tubes within the second subset of individual tubes to reduce the rate of the second mass flow relative to the rate of the first mass flow or is a valve that restricts the second mass flow to one or more of the individual tubes within the second subset of individual tubes.

38. The process of claim 19, wherein said heavy refrigerant fraction becomes a second tube side stream which is introduced into the warm end of said warm tube bundle as a liquid and exits at the cold end of said warm tube bundle as a sub-cooled heavy refrigerant stream in liquid form, and part of said light refrigerant fraction becomes a third tube side stream which is introduced into the warm end of said warm tube bundle as a gas and exits at the cold end of said cold tube bundle as a sub-cooled liquid light refrigerant stream.

39. The process of claim 38, wherein the sub-cooled heavy refrigerant stream removed at the cold end of said warm tube bundle is expanded across a first expansion device to form a reduced pressure heavy refrigerant stream that is then introduced into the shell side of said main heat exchanger at a location intermediate between the cold end of said warm tube bundle and the warm end of said cold tube bundle, and wherein said reduced pressure heavy refrigerant stream is allowed to evaporate in the shell side, thereby cooling the fluids in the first, second and third tube side streams as they pass through said warm tube bundle, and said sub-cooled liquid light refrigerant stream removed from the cold end of said cold tube bundle is expanded through a second expansion device to cause a reduction in pressure and produce a reduced pressure light refrigerant stream, and the reduced pressure light refrigerant stream is introduced into the shell side of said main heat exchanger at the cold end of said main heat exchanger, and wherein said reduced pressure light refrigerant stream is allowed to evaporate in the shell side, thereby cooling the fluids in the first and third tube side streams as they travel through said cold tube bundle as well as providing cooling to the fluids in the first, second and third tube side streams as they travel through said warm tube bundle.

* * * * *